United States Patent [19]

Garcia

[11] 4,423,588

[45] Jan. 3, 1984

[54] APPARATUS FOR PAYING OFF WIRE FROM A BOBBIN

[75] Inventor: Ricardo A. M. Garcia, Ciudad Satelite, Mexico

[73] Assignee: Trimak Equipment Ltd., George Town, Grand Cayman, British West Indies

[21] Appl. No.: 313,792

[22] Filed: Oct. 22, 1981

[51] Int. Cl.[3] ..... D07B 7/02

[52] U.S. Cl. ..... 57/127.5; 57/127.7; 242/156.2

[58] Field of Search ..... 57/58.3, 58.32, 58.36, 57/58.72, 58.83, 58.86, 59, 65, 127.5, 127.7, 264; 242/45, 129.6, 129.62, 155 R, 156, 156.2

[56] References Cited

U.S. PATENT DOCUMENTS

| | | | |
|---|---|---|---|
| 1,579,769 | 4/1926 | Jones | 57/59 |
| 2,277,102 | 3/1942 | Henning et al. | 57/127.7 X |
| 2,920,840 | 1/1960 | Cooper | 242/156.2 |
| 3,351,302 | 11/1967 | Lang | 242/156.2 |

*Primary Examiner*—Donald Watkins

*Attorney, Agent, or Firm*—Myron Greenspan; Burton L. Lilling; Bruce E. Lilling

[57] ABSTRACT

Wire payoff devices are described which are used in conjunction with bobbin supporting cradles typically found in wire stranding and cabling machines such as high speed tubular stranders, bow or skip stranders and planetary stranders. The payoff devices include dancer arrangements each having a pair of pulley wheels mounted on a common support member which is itself mounted for independent movements along two substantially orthogonal directions. One of the pulley wheels is effectively fixed and continuously releases the wire along the axis of the cradle. The other or receiving pulley repeatedly traverses the axial width of the bobbin to follow the take-off points of the wire to provide uniform take-off and prevent scraping or chafing of the wire. Movements of the receiving pulley towards and away from the bobbin as a function of the tension of the wire is translated, by means of pivoted lever arms, to a variable frictional force applied to the bobbin which substantially maintains the tension in the wire to a pre-established value.

16 Claims, 8 Drawing Figures

APPARATUS FOR PAYING OFF WIRE FROM A BOBBIN

BACKGROUND OF THE INVENTION

The present invention generally relates to bobbin wire or filament payoff and brake systems which, for example, can be used in high speed cable or wire stranders, and more specifically in any type of strander that utilizes cradles as support members for the bobbins. Examples of such stranders are tubular stranders, bow or skip stranders and planetary stranders.

When manufacturing a cable from a plurality of wires, a core wire formed by either a single wire or a plurality of already stranded wire is usually passed through the machine and other wires are wrapped around the core wire either while the core wire moves along its path or at the end of the machine. This function is usually carried out by high speed machines which as a rule include one or more rotatable frames or housings and a plurality of wire carrying bobbins located within the frame or carried by supports mounted on the frames.

The bobbins are usually mounted within the frame in cradles or are mounted directly on the frame using a variety of support systems like shafts or pintles. In the manufacturing of stranded conductors or cables from a plurality of wires, five basic types of stranders are presently used in the industry. In tubular stranders, bow or skip stranders and planetary stranders, the bobbins are placed in cradles and supported by shafts or pintles. In tubular and bow type stranders, the frame rotates during operation while the cradles are stationary. In planetary stranders, the bobbins are mounted on cradles which are kept in a fixed plane through mechanical means while the machine rotates. In rigid stranders, the bobbins are directly supported by the frame either through shafts or pintles, and in fly-off stranders the bobbins are carried by the frame and do not rotate during operation.

Wire carrying bobbins mounted on cradles are usually required to rotate along their own longitudinal axis in order to pay out their wire. In the past, this arrangement usually required some control of the rotation of the bobbins, such as a brake mechanism for each bobbin, so that the bobbins do not continue to rotate when the frame of the strander stops its rotation. Such braking device causes the tension of the wire paid off from the bobbins to vary during the operation of the strander since the wire pulling tension required to make the bobbin rotate is different when the bobbin is full or near empty. If the initial braking force is adjusted for a full bobbin, the same braking force applied to a bobbin with partially depleted wire supply is sometimes sufficient to cause unacceptable stretch or breaks in the wire, especially for wires of the smaller gauges. This has, in the past, limited the use of large bobbins for stranding small gauges of wire. In the case where the wire is stretched, the cable produced will be malformed. Also, since the braking force is applied to each bobbin before the initial start of the strander, there is a tendency to stretch the wire before the strander reaches its normal operational speed. Because of frequent maladjustments of the brakes, the wires from the bobbins within the frame of the strander occasionally continue to pay out after the strander has been stopped, and because different brake forces are applied to different bobbins, different tensions are created in the wire paid out from the bobbins.

Therefore, many times, the cable formed by stranders having traditional brake systems have one or more wires loosely wrapped with the remaining wire more tightly wrapped.

Also known is a bobbin brake arrangement which includes a dancer mechanism having a portion thereof abutting against the outermost wires remaining on the bobbin to thereby monitor the amount of wire left on the bobbin. The dancer mechanism is coupled to an adjusting brake, the amount of braking action being a function of the amount of wire remaining on the bobbin. However, such a braking arrangement does not take into account and cannot compensate for acceleration and deceleration of the bobbin. Therefore, excessive tensions can still result when the bobbin is accelerated at any rotating speed and, particularly, from a standing or still condition. The device under discussion likewise may result in overfeeding of the wire during deceleration or abrupt stopping of the bobbin.

The wire, unwound from each bobbin is usually brought out through the front of the cradle by means of an eyelet commonly made of wear-resistant material. The distance between the axis of rotation of the bobbin and the eyelet in the front of the cradle, through which the wire exits from the cradle, depends on the type of wire used and the application. It cannot be reduced below certain limits because in such cases the angle with which the wire enters the eyelet would be too steep and the wire could be damaged or break under the excessive tension required to pull it through the eyelet. This angle is called the "fleeting angle" in the industry, and is normally between 20° and 35°, depending on the nature of the wire used.

The requirement to keep the fleeting angle below certain limits determines the length of the front part of the cradle and therefore the overall length and cost of the entire machine. A shorter machine is obviously less expensive but in the present state of the art shorter machines cannot manufacture cables of satisfactory quality because the wire surface would be too damaged. Furthermore, in shorter machines with conventional payoff and frame systems, the chances of wire breaks and consequent higher scrap rates and production losses are very much increased so as to make such machines inefficient to operate.

The fleeting angle also cannot be decreased below certain limits for another reason. During unwinding from the bobbin, the wire travels from one flange to the center to the other flange and vice versa. When the wire is pulled from positions near each flange, it is not pulled at 90° from the axis of rotation ob the bobbin as it should in order to have a perfect unwinding, but it is pulled at an angle that depends on the width of the bobbin and the distance of the exit eyelet from the bobbin. Therefore, at these positions the wire is pulled over the underlying layer, thus scraping and chafing the surface. This damage is not acceptable in many applications and in order to avoid it, long machines and sometimes narrow bobbins with lower capacity must be used. This practice increases the stops for loading and unloading the machine and lowers the productivity of the equipment.

SUMMARY OF THE INVENTION

It is, therefore, an object of the present invention to provide a wire payoff apparatus which eliminates the abovedescribed disadvantages of existing payoff arrangements.

It is another object of the invention to provide a wire payoff apparatus which includes a bobbin braking system that will maintain a constant tension on each wire throughout the operation of the strander, including during periods of acceleration and deceleration.

It is still another object of the invention to provide a wire payoff apparatus which allows a strander to form a cable which has each individual wire wrapped about the core with approximately the same wrapping tension thus allowing the manufacture of a better stranded cable at higher speeds and efficiency.

It is yet another object of the invention to provide a wire payoff apparatus that allows the construction of shorter and therefore less expensive machines.

It is a further object of the invention to provide a dancer pay-out system which follows the wire from flange to flange during the unwinding operation, thereby unwinding the wire at substantially 90° to the axis of rotation of the bobbin and thus eliminating a major cause of surface damage to the wire and allowing the use of wider bobbins with higher capacity for a given application.

In order to achieve the above objects, as well as others which will become apparent hereafter, an apparatus for paying off wire from a bobbin mounted for rotation about its longitudinal axis in a high speed strander cradle in accordance accordance with the present invention comprises wire guide means for guiding the wire from the bobbin to a path substantially coincidental with the longitudinal axis of the cradle. A reference tension is established in the wire by presetting of adjusting means. Braking means are provided for applying variable braking torques to the bobbin. Said wire guide means is in the nature of a feedback device continuously comparing the actual tension in the wire with the reference tension and moving about an equilibrium position as a function of the deviations of the actual tension of the wire from the reference tension. Actuating means are provided connected to said wire guide means and said braking means is continuously adjust the torque on the bobbin to thereby maintain the tension in the wire substantially equal to the reference tension during operation of the strander.

In the presently preferred embodiments, wire is pulled off the bobbin and passed through a dancer arrangement which has been preset for a desired tension. In turn, the position of the dancer determines the braking torque applied to each bobbin, completing a feedback link and, in effect, maintaining a constant tension on the wire for virtually any operating situation from start-up, to operation, to stopping. For example, at the initial start-up if the tension on the wire is increased, the brake force could be reduced to zero. On the other hand, during stops the full torque of the brake is applied which can be made much greater than the torque required during normal operation.

Although only several embodiments are described, many others incorporating the principles of the present invention may be devised. All of these, however, include the advantageous features that they allow a strander to operate in such a way as to form cables at high speeds substantially without the hazard of forming a cable with loose or drawn down wire strands. The payoff apparatus of the present invention also allows the construction of shorter machines than the present arrangements while maintaining a high surface quality in the cable produced. The same device also allows the continuous unwinding of the wire at substantially 90° to the axis of rotation of the bobbin, thus completely eliminating the problem of wire scraping and chafing during unwinding of turns near the flanges.

Because the subject device provides dynamic adjustments and can compensate for acceleration and deceleration of the bobbin, the wire processing machines, such as stranders, can be started and stopped more quickly without damage to the wire.

An additional advantageous feature of the construction of the invention is that since the wire is guided by rollers from the bobbin to the exit point on the strander, such as an eyelet, and since the wire is released along a path substantially coincident with the axis of the cradle and, therefore, the eyelet, the wire experiences significantly less tension. Since the fleeting angle is reduced to zero at the entrance point of the eyelet, the wire experiences friction only at the exit point thereby reducing the friction effectively by approximately one-half. Such a reduction in friction and tension in the wire allows the processing of higher gauge wires which are susceptible to more frequent breakage.

BRIEF DESCRIPTION OF THE DRAWINGS

Other and further objects of this invention will be more apparent hereinafter from an examination of the specification and claims in conjunction with the accompanying drawings, wherein:

DETAILED DESCRIPTION OF THE PREFERRED EMBODIMENTS

Figure 1:
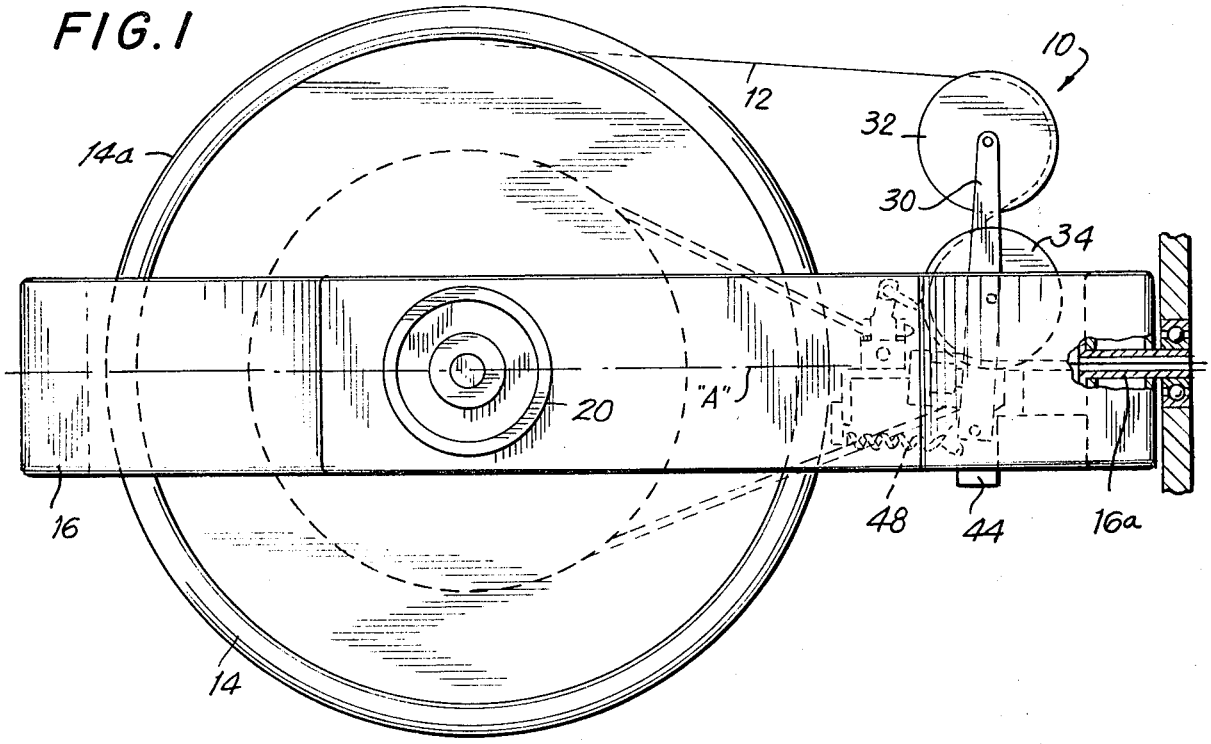
FIG. 1 is a side elevational view of a bobbin mounted in a cradle, and incorporating the payoff device in accordance with the present invention.
Figure 2:
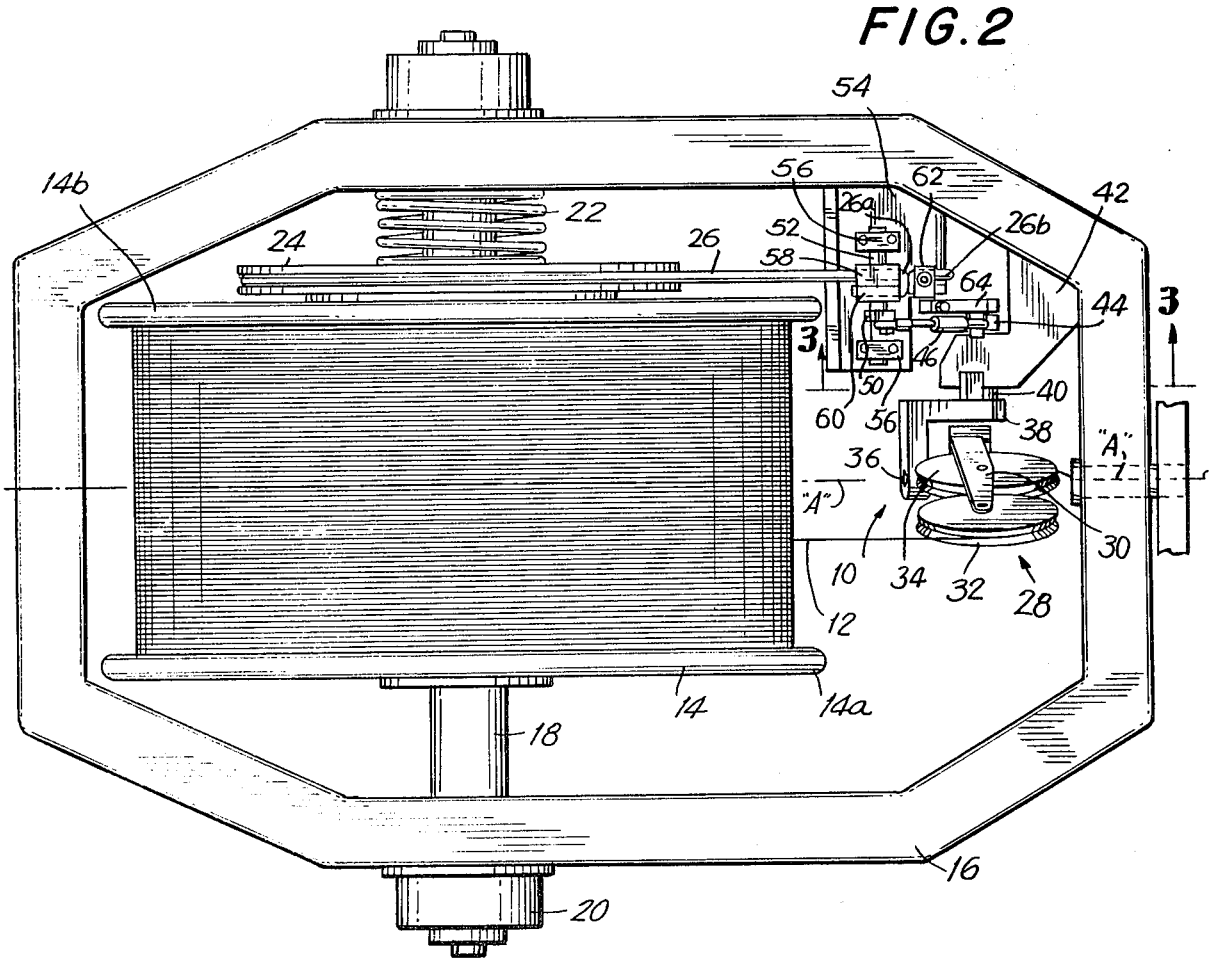
FIG. 2 is a top plan view of the cradle, bobbin and payoff device shown in FIG. 1.
Figure 3:
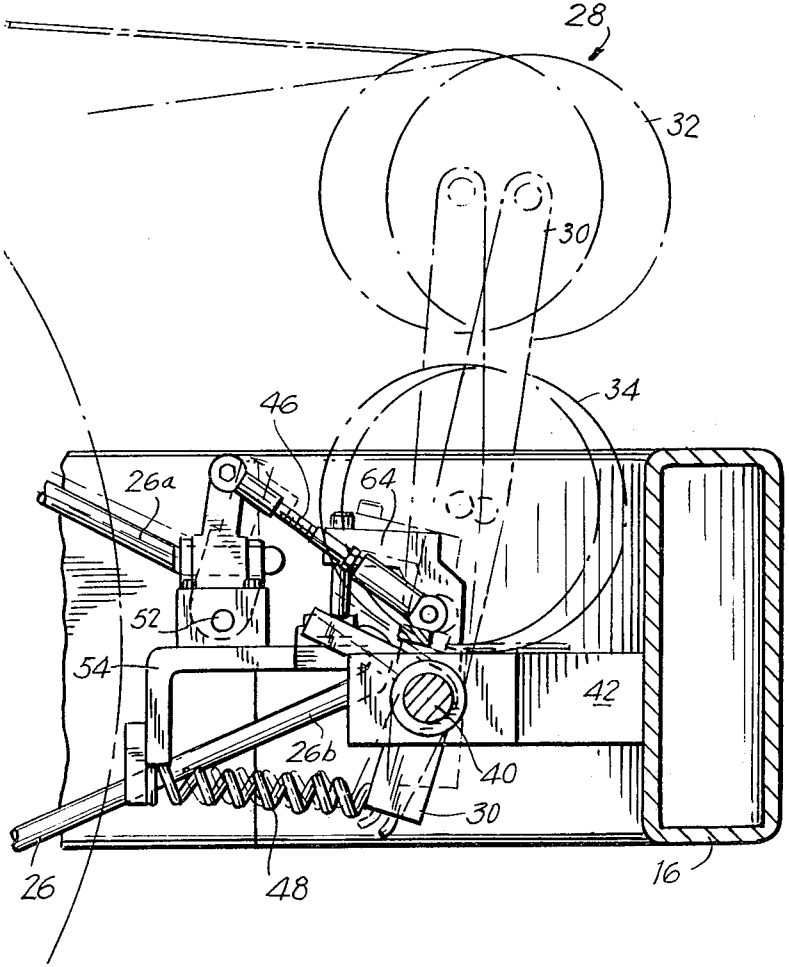
FIG. 3 is a fragmented cross-sectional view of the payoff device shown in FIG. 2, taken along line 3—3, and showing in phantom outline two different positions of a dancer mechanism, which forms part of the payoff device, which positions are functions of the tension in the wire.

Referring now specifically to the figures, in which identical or similar parts are designated by the same reference numerals throughout, and first referring to FIGS. 1–3, the take-off or payoff device in accordance with the present invention is generally designated by the reference numeral 10.

The payoff device 10 is arranged, as will be evident from the description that follows, to pay off wire 12 from a bobbin 14 which is mounted for rotation about its longitudinal axis on a cradle 16. Such cradles are typically used on stranders such as tubular stranders, bow or skip stranders, and planetary stranders. When the bobbins are supported in the cradles as shown, the wires are usually pulled off the bobbins and guided through a bushing or sleeve 16*a* provided at one end of the cradle. In a tubular strander, for example, the bushings or sleeves 16*a* are aligned on the axis of rotation "A" of the machine. In the past, for reasons described in the Background Of The Invention, it was not possible to position the bushing or sleeve 16*a* close to the bobbin 14 since to do so would create the already mentioned unwinding problems. With the payoff device of the present invention, these problems are eliminated and the overall length of the cradles can be substantially reduced.

As is best seen in FIG. 2, the bobbin 14 is mounted on shafts 18 which are typically terminated by pintle assemblies. See, for example, U.S. Pat. No. 4,079,580 assigned to the assignee of the subject application. Any conventional means 20 for extending and retracting the shafts 18 in order to secure and release the bobbins from the cradle may be used, in conjunction with a conventional spring 22 as shown.

One important feature of the present invention is the provision of braking means for applying variable braking torques to the bobbin. Again referring to FIGS. 1–3, such brake is shown to include a brake disc 24 and a brake cable 26 extending about the brake disc 24, one end of the brake cable 26*a* being a movable cable end, while the cable end 26*b* is fixed in position so that selectively applying varying tensions to the movable cable end 26*a* results in changes in frictional forces applied to the brake disc 24 and, therefore, to the braking torques on the bobbin 14.

A further important feature of the present invention is the provision of a dancer assembly generally designated by the reference numeral 28 which is in the nature of wire guide means for continuously guiding the wire 12 from the bobbin 14 to a path substantially coincident with the axis "A" of the cradle 16 or the axis of rotation of the strander when such cradles are mounted in, for example, a tubular stranding machine.

The dancer assembly 28 includes a dancer arm 30 and two spaced pulley wheels, an upper pulley wheel 32 and a lower pulley wheel 34, mounted for rotation on the dancer arm 30. The upper pulley wheel 32 serves as a receiving pulley wheel for receiving the wire 12 as it leaves the bobbin 14. The lower pulley wheel 34 serves as a transmitting pulley wheel which has a peripheral portion thereof substantially tangent to the axis "A" and, therefore, the desired path of the wire.

Figure 4:
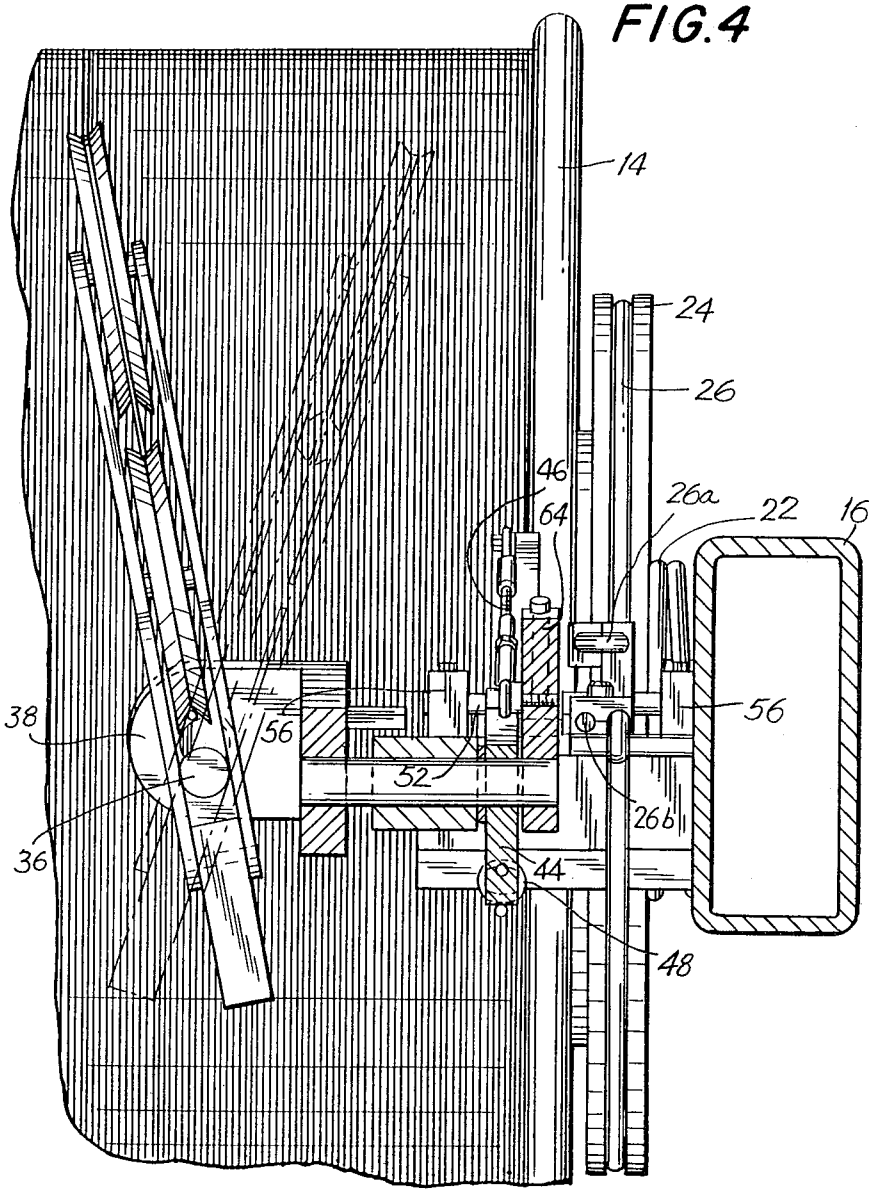
FIG. 4 is a fragmented cross-sectional view of the payoff device shown in FIG. 3, taken along line 4—4, showing in solid and in phantom outline two different positions of the dancer mechanism while traversing the width of the bobbin from flange to flange while paying off the wire from the bobbin in directions substantially 90° from the axis of rotation of the bobbin.

The dancer arm 30 is mounted for pivotal rotation about a pivot pin 36 on an L-shaped bracket 38. This allows transverse oscillating movements of the pulley wheel 32 with respect to the width of the bobbin 14 thereby following the wire as it is removed from the bobbin and minimizing scraping and chafing of the wire. As is best shown in FIGS. 2 and 4, the pivotal movements of the dancer arm 30 about the pivot pin 36 allows the wire to be drawn off the bobbin along a direction substantially 90° to the axis of rotation of the bobbin. The unwinding of the bobbin is, therefore, performed in a reverse manner in which it is initially wound and this provides for a smoother and more even and uniform unwinding of the wire.

The L-shaped bracket 38 is pivotally mounted by means of a shaft 40 on a support member or platform 42 which is fixed to the cradle 16. With this arrangement, the L-shaped bracket 38 and, therefore, the dancer arm 30, are also mounted for pivotal rotation about an axis substantially parallel to the axis of rotation of the bobbin 14 to assume positions which are a function of the tension in the wire 12. The shaft 40 is connected to a bell crank 44 so that the L-shaped bracket 38 and the bell crank 44 share common rotational movements about the shaft 40. The upper end of the bell crank is connected to an adjustable linkage 46, while the lower end of the bell crank is connected by means of a tension spring 48 to a fixed point in relation to the cradle 16. The linkage 46 is, in turn, connected to a torque lever 50 which is rigidly connected to a shaft 52 which is supported on a brake arm support member 54 by means of shaft mount retainers 56. Also fixedly secured to the shaft 52 for rotation therewith is a brake arm lever 58 which is connected to the movable cable end 26*a* which is securely attached to the lever 58 by means of a cable end retainer 60. The fixed cable end 26*b* is secured to the brake arm support member 54 by means of a cable end retainer 62. It will thus be seen that the pivotal movements of the dancer arm 30 about the shaft 40 is effective to rotate the brake arm lever 58 and, therefore, adjust the tension in the brake cable 26.

A pre-tension adjustment element 64 can be manually adjusted to control to any desired extent the biassing action of the spring 48 upon the bell crank 44. With the arrangement described, the braking forces on the bobbin are decreased when the tension in the wire increases above the desired tension, and are increased when the tension in the wire decreases below the desired tension. In effect, the dancer assembly 28 is in the nature of a feedback device which continuously compares the actual tension in the wire 12 with the reference tension established by the element 64 and the spring 48 and moves about an equilibrium position as a function of the deviations of the actual tensions in the wire 12 from the preselected reference tension. The elements connected between the dancer assembly 28 and the brake cable 26 may be characterized as comprising actuating means since they continuously adjust the torque on the bobbin 14 to maintain the tension in the wire substantially equal to the reference tension during operation or unwinding of the bobbin. Referring to FIG. 3, two different positions of the dancer assembly 28 are shown in phantom outline which positions might be assumed for two different tensions in the wire 12. It should be noted that both the brake adjusting feature as well as the bobbin traversal feature of the dancer assembly are dynamic, constantly and automatically adjusting for the position of the wire 12 as well as the tension therein, and requires no additional or external monitoring or actuation.

Figure 5:
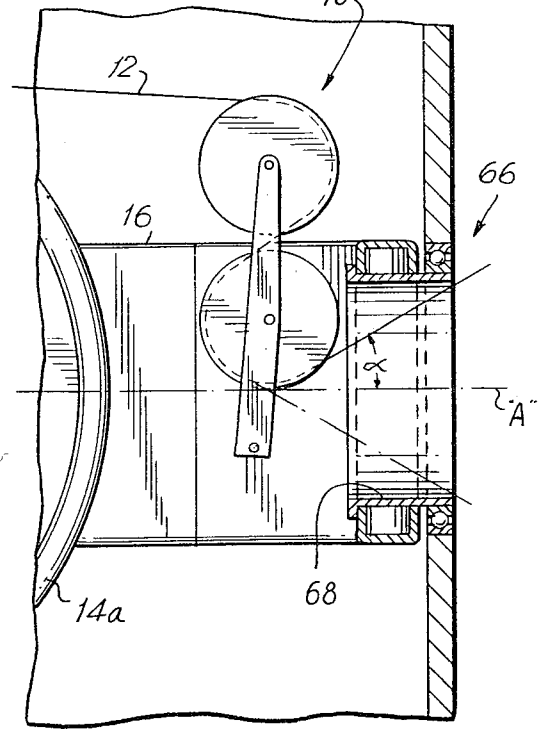
FIG. 5 is a fragmented and diagrammatic view of a payoff device in accordance with the present invention shown in the environment of a tubular strander to illustrate how the wires can be passed through the bearings of the strander at substantial angles while shortening the length of the machine while eliminating the use of exit eyelets.

In FIG. 5, the advantages of the payoff device 10 in accordance with the present invention is further made evident. Here, the dancer assembly 10 is shown schematically in a tubular strander wherein the wire 12 is passed through a bearing 66 having an opening 68 as shown. Because of the ability of the dancer mechanism to offset the position of a wire as well as change the direction thereof, the present invention is particularly suitable for use in stranding machines since these machines can now be significantly shortened thereby effecting significant cost economies. In FIG. 5, the versatility of the dancer assembly 10 is shown whereby it not only can reduce the length of the tubular strander but can release the wire at an angle $\alpha$ which, of course, is a function of the diameter of the opening 68. However, such a construction eliminates pulleys, guides and eyelets which have heretofore been required. Not only are some of these elements eliminated, but as it should be clear from FIG. 5 the wire is now permitted to proceed to the next successive strander section without rubbing or chafing.

Figure 6:
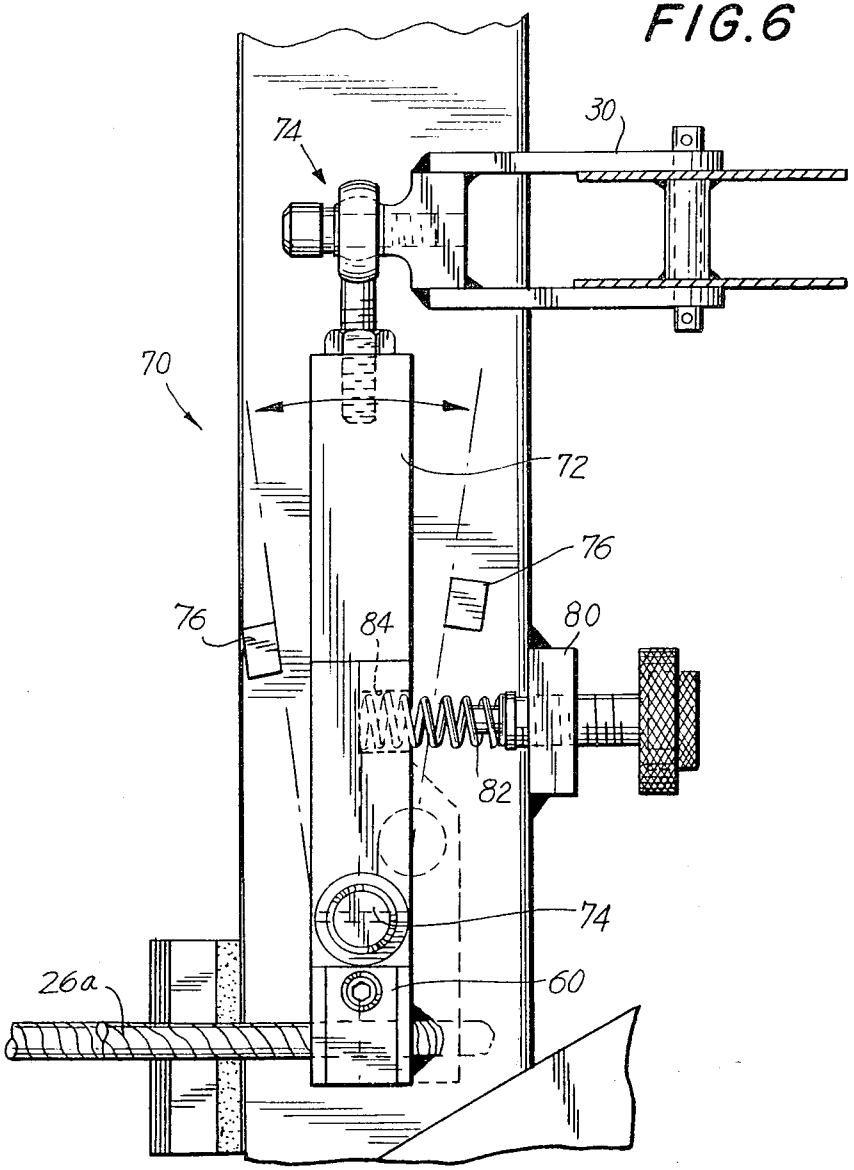
FIG. 6 is a fragmented top plan view of a portion of a wire payoff device in accordance with the present invention, showing another embodiment thereof.

Another embodiment of the payoff device is shown in FIG. 6 and designated by the reference numeral 70. The principle of operation is essentially identical, the dancer arm 30 again being pivotally mounted to respond to variations in tension in the wire, such movements being translated to varying tensions applied to the brake cord 20 to affect frictional torques on the brake. In FIG. 6, a lever 72 is pivotally mounted on a pin or shaft 74 as shown. The movable cord end 26*a* of the brake is connected to one end of the lever 72, the cord being fixed to that lever by means of a cord clamp 60. A ball socket joint connects the other end of the lever 72 to the dancer arm 30. Movements of the dancer arm in the directions indicated by the double-headed arrow causes the lever 72 to pivot about the pin or shaft 74 for movements about the central equilibrium position between the limits indicated by the dashed lines. Lugs 76 may be provided to serve as stops to prevent excessive movements of lever 72. Movement of the ball socket joint, for example, to the left as viewed in FIG. 6 would increase the tension in the brake cord 26 and increased braking action would result. Movement of the ball socket joint to the right would decrease such tension. Pre-setting of the dancer arm 30 may be effected by a screw having a knurled nob 78 which is threadedly engaged with a threaded block 80. The screw connected to the nob 78 can be turned to adjustably apply biassing forces on the lever 72 by means of compression spring 82. For this purpose, a hole or recess 84 may be provided in the lever 72 for receiving one end of the spring 82, while the other abuts against the end of the adjusting screw.

Figure 8:
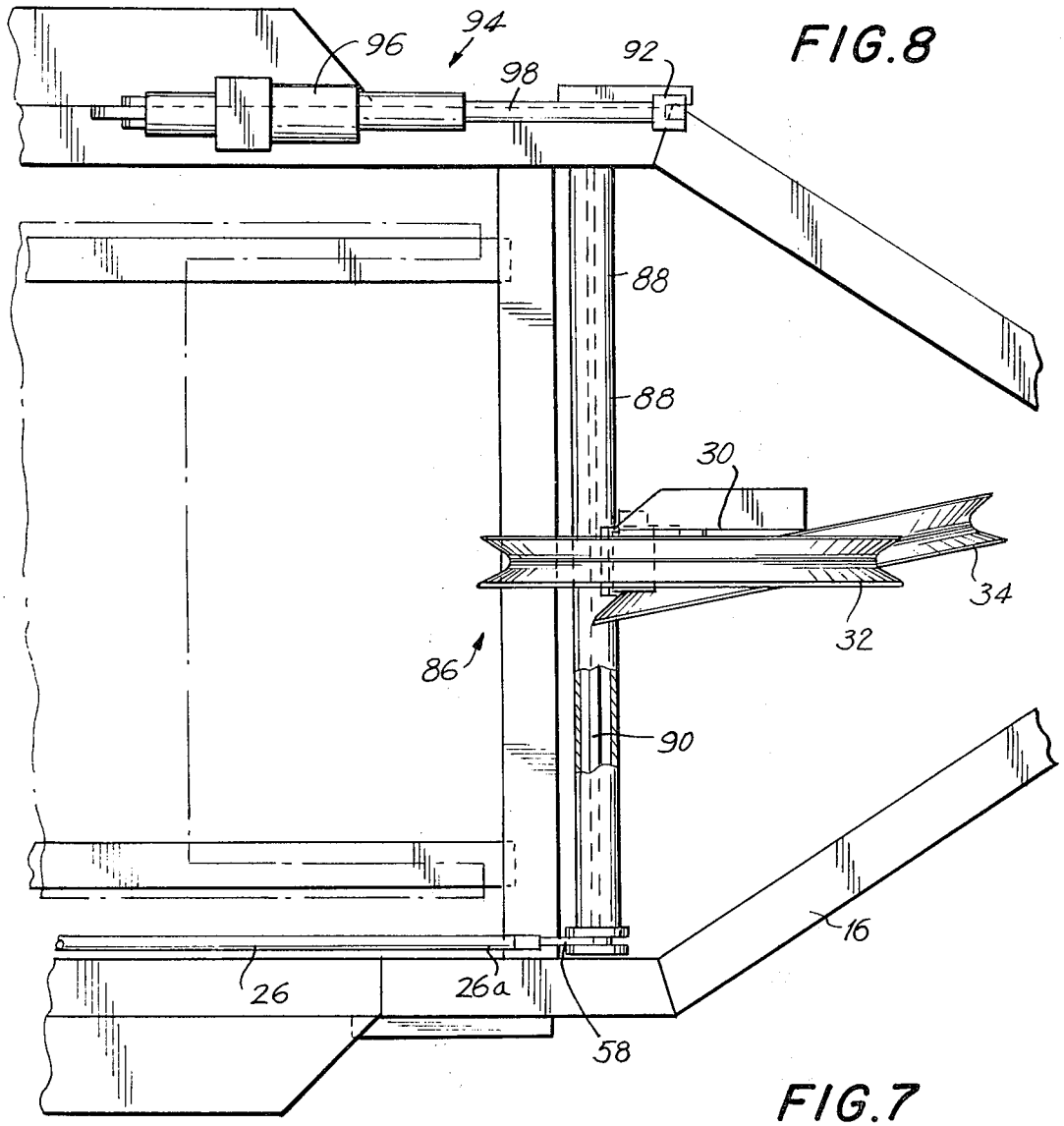
FIG. 8 is a fragmented top plan view of the bow strander shown in FIG. 7, and illustrating still another embodiment of the payoff device.
Figure 7:
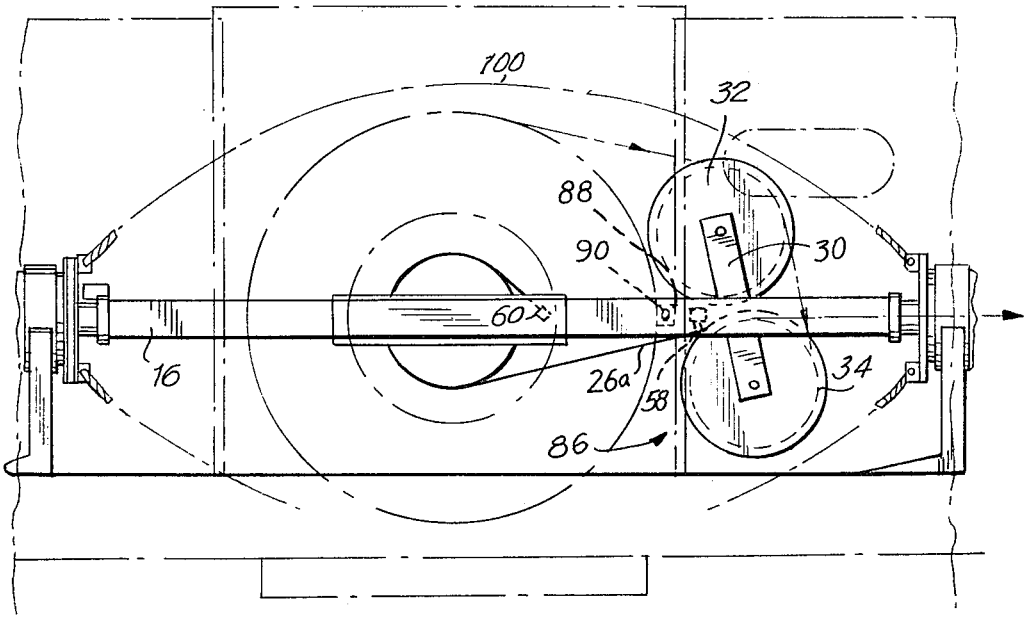
FIG. 7 is a side elevational diagrammatic view of a bow strander, showing another arrangement of the dancer mechanism.

Referring to FIGS. 7 and 8, still another embodiment of the invention is illustrated, this time shown in the environment of a bow strander. Here, as in the previously described embodiments, an actuator arm 58 is connected to the movable brake cable end 26*a*. The payoff device, generally designated by the reference numeral 86, includes a tube 88 which extends across the cradle 16 and is generally parallel to the axis of the bobbin. The actuator arm 58 is rigidly connected to the tube 88. The tube 88 is hollow and includes a torsion rod 90 contained within and coaxial with the tube 88. The torsion rod 90 is connected to the tube 88 at the ends proximate to the actuator arm 58. The other end of the torsion rod 90 is connected to positioning means for pre-setting the angular position of the torsion rod and thereby the position of the dancer arm 30. Referring to FIG. 8, the positioning means is shown as comprising a positioning lever arm 92 connected to the torsion rod, and an adjusting assembly 94 which includes an actuating element 96 and a piston shaft 98 connected to the lever arm 92. Since the torsion rod 90 and the tube 88 are connected to each other at one end, extension of the hydraulic shaft 98 effectively rotates the dancer arm 30 in a direction away from the bobbin, while retraction of the shaft 98 tends to move the dancer arm in the direction of the bobbin. These initial position pre-setting adjustments establish a reference tension in the wire.

In FIGS. 1–5, the dancer arm is shown mounted to position both pulley wheels to one side of the desired path of the wire, namely the axis "A". With such arrangement of the dancer, the wire 12 is guided over the receiving pulley 32 and subsequently passes between the two pulleys 32, 34 before being guided over the transmitting pulley 34 and being released or guided along the desired path. Referring to FIG. 7, the dancer arm 30 is shown mounted to position the two pulley wheels 32, 34 on opposite sides of the desired path of axis or the machine. Here, the wire is guided over the receiving pulley 32, and subsequently the wire proceeds over the transmitting pulley 34 before passing between the pulleys 32, 34 and being released along the desired path. This arrangement is useful in bow stranders since the pulley wheels 32 and 34 are substantially symmetrically arranged about the cradle 16, providing clearance for the bows 100, which are generally parabolic in configuration.

When the pulley wheels 32, 34 are symmetrically disposed in relation to the cradle 16, the receiving and transmitting pulleys 32, 34 respectively are advantageously angularly offset from each other on the dancer arm as shown in FIG. 8 to avoid scraping of the wire 12 as it traverses itself where the wire is guided into and from the lower or transmitting pulley wheel 34 proximate to the desired path of the wire 12.

The descriptions herein have been of representative embodiments, and variations and modifications thereof may be possible without departing from the spirit of the invention. Thus, for example, the use of a brake disc and cable is not critical and any type of braking arrangement may be used. Instead, it is possible to use electrical rotating machine, such as torque motors, or clutches which can selectively apply braking action. Also, while the dancer assembly performs the important functions in a very simple and economical way, it is not essential that both pulley wheels are mounted for movements as described. By way of example only, it is possible to mount the receiving pulley 32 on an elongate transverse track by means of linear bearings or the like and allowing the receiving pulley to traverse the bobbin in a direction which is truly transverse to the bobbin and parallel to the bobbin axis. Mounting of the receiving pulley wheel on a linear track or guide achieves one of the important features of the invention, namely smooth and even take-off without scraping or chafing. Further, although the dancer assembly has been described as including pulley wheels, it should be evident that any combinations of rotating or fixed guide elements may be used such as rollers, rods, eyelets or the like. Also, the use of two rotating guide elements or pulley wheels on a dancer arm is not critical. Two or more guide elements may be used on dancer arms having different lengths to provide different responsiveness of the braking action. Finally, while the described embodiments provide both normal take-off and automatic tension control or bobbin braking action, it should also be evident that either feature can be used without using the other. The constructions described, providing both features, provide optimum results. However, it is possible to provide automatic braking or tension control without following the wire for normal take-off or provide for normal take-off without tension control.

What is claimed is:

1. Apparatus for paying off wire from a bobbin mounted for rotation about its longitudinal axis in a high speed strander cradle, comprising:

(a) wire guide means for guiding the wire from the bobbin along a path substantially normal to the axis of the bobbin to a path substantially coincident with the longitudinal axis of the cradle;

(b) adjusting means for presetting said wire guide means to establish a reference tension in the wire;

(c) braking means for applying variable braking torques to the bobbin, said wire guide means being in the nature of a feedback device continuously comparing the actual tension in the wire with the reference tension and moving about an equilibrium position as a function of the deviations of the actual tension in the wire from the reference tension; and (d) actuating means connected to said wire guide means and said braking means to continuously adjust the torque on the bobbin to thereby maintain the tension in the wire substantially equal to the reference tension during operation of the strander.

2. Apparatus as defined in claim 1, wherein said wire guide means comprises a dancer arm; spaced rotating guide elements mounted on said dancer arm, one of said guide elements being a receiving guide element for receiving the wire as it leaves the bobbin, and another of said guide elements being a transmitting guide element having a portion thereof substantially tangent to the desired path of the wire, whereby the wire may be guided over said guide elements and be released along the desired path.

3. Apparatus as defined in claim 2, wherein at least one of said guide elements comprises a pulley wheel.

4. Apparatus as defined in claim 3, wherein two pulley wheels are provided on said dancer arm.

5. Apparatus as defined in claim 4, wherein the dancer arm is mounted for transverse oscillating movements with respect to the axial length of the bobbin for following the wire as it is removed from the bobbin thereby minimizing scraping and chafing of the wire, said dancer arm also being mounted for pivotal rotation about an axis substantially parallel to the axis of rotation of the bobbin to assume positions which are a function of the tension in the wire.

6. Apparatus as defined in claim 4, wherein said dancer arm is mounted to position both pulley wheels to one side of the desired paths of the wire, whereby the wire is guided over the receiving pulley and passes between the pulleys before being guided over the transmitting pulley and being released along the desired path.

7. Apparatus as defined in claim 4, wherein said dancer arm is mounted to position the two pulley wheels on opposite sides of the desired path of the wire, whereby the wire is guided over the receiving pulley, and proceeds to be guided over the transmitting pulley before passing between said pulleys and being released along the desired path.

8. Apparatus as defined in claim 7, wherein said pulleys are angularly offset from each other on said dancer arm to avoid scraping of the wire as it traverses itself where the wire is guided into and from said transmitting pulley proximate to the desired path of the wire.

9. Apparatus as defined in claim 1, wherein said braking means comprises a brake disc associated with the bobbin; and a brake cable extending about said brake disc, one end of said brake cable being fixed and the free other end of said brake cable being connected to said adjusting means.

10. Apparatus as defined in claim 9, wherein said adjusting means comprises pivotally mounted brake arm lever connected to the free end of said brake cable; and linkage means connected to said wire guide means for changing the braking forces applied by said brake cable by rotating said brake arm lever.

11. Apparatus as defined in claim 9, wherein said adjusting means comprises a pivotally mounted lever, the free end of said brake cable being connected to one end of said lever; and a ball socket joint connecting the other end of said lever to said wire guide means.

12. Apparatus as defined in claim 9, wherein said adjusting means comprises a brake arm connected to the free end of said brake cable; a tube supporting said brake arm; said wire guide means being supported on said tube, whereby changes of tension in the wire cause said tube and said brake arm to rotate about the axis of said tube.

13. Apparatus as defined in claim 12, wherein said adjusting means comprises a torsion rod contained within and coaxial with said tube, said torsion rod being connected at one end to said tube and at the other end to positioning means for presetting the angular position of said torsion rod and thereby the position of said wire guide means.

14. Apparatus as defind in claim 13, wherein said positioning means comprises a positioning lever arm connected to said torsion rod; and hydraulic means for selectively rotating said lever arm.

15. Apparatus as defined in claim 1, wherein said adjusting means comprises resilient means acting on said wire guide means; and means for selectively modifying the resilient forces acting on said wire guide means.

16. Apparatus for paying off wire from a bobbin mounted for rotation about its longitudinal axis in a high speed strander cradle, comprising:

(a) wire guide means for guiding the wire from the bobbin along a path substantially normal to the axis of the bobbin to a path substantially coincident with the longitudinal axis of the cradle, said guide means including guide elements, one of said guide elements being a receiving guide element for receiving the wire as it leaves the bobbin, and another of said guide elements being a transmitting guide element having a portion thereof substantially tangent to the desired path of the wire, whereby the wire may be guided over said guide elements and be released along the desired path; and (b) means for mounting at least said receiving guide elements for oscillating transverse movements with respect to the axial length of the bobbin for following the wire as it is removed from the bobbin thereby minimizing scraping and chafing of the wire.

* * * * *